US011826882B1

(12) United States Patent
Enegren

(10) Patent No.: US 11,826,882 B1
(45) Date of Patent: Nov. 28, 2023

(54) BLAST WHEEL AND QUICK-CONNECT BLADE ASSEMBLY

(71) Applicant: Paul Enegren, Wichita, KS (US)

(72) Inventor: Paul Enegren, Wichita, KS (US)

( * ) Notice: Subject to any disclaimer, the term of this patent is extended or adjusted under 35 U.S.C. 154(b) by 0 days.

(21) Appl. No.: 18/089,291

(22) Filed: Dec. 27, 2022

(51) Int. Cl.

| | |
|---|---|
| ***B24B 5/06*** | (2006.01) |
| ***B24B 3/30*** | (2006.01) |
| ***B24C 5/06*** | (2006.01) |
| ***B24C 3/30*** | (2006.01) |

(52) U.S. Cl.
CPC ..... *B24C 5/062* (2013.01); *B24C 3/30* (2013.01); *B24C 5/066* (2013.01)

(58) Field of Classification Search
CPC .... B24B 3/14; B24B 3/24; B24B 3/30; B24B 5/06; B24B 5/062; B24B 5/066
USPC ..... 451/86, 95, 97, 98
See application file for complete search history.

(56) References Cited

U.S. PATENT DOCUMENTS 3,352,064 A * 11/1967 De Groot ..... B24C 5/062 451/97
3,654,736 A * 4/1972 De Groot ..... B24C 5/062 451/97
3,785,105 A * 1/1974 Freeman ..... B24C 5/06 451/97
3,894,360 A * 7/1975 DeGroot ..... B24C 5/062 241/275
3,936,979 A * 2/1976 Fuerst ..... B24C 5/062 241/275
4,047,843 A * 9/1977 Zeidler ..... B24C 5/062 416/185
4,249,350 A * 2/1981 Goff ..... B24C 5/062 451/97
6,447,378 B1 * 9/2002 Hoff ..... B24C 5/062 451/98
6,981,910 B1 1/2006 Goff
7,311,584 B2 12/2007 Goff
7,585,207 B2 9/2009 Barriger
8,043,141 B1 10/2011 Goff
(Continued)

FOREIGN PATENT DOCUMENTS

EP 0359143 A2 * 3/1990
GB 1359068 A * 7/1974 ..... B24C 5/06
(Continued)

*Primary Examiner* — Eileen P Morgan
(74) *Attorney, Agent, or Firm* — Dale J. Ream

(57) ABSTRACT

A shot blasting wheel for use with a shot blasting machine configured to propel abrasive shot against a workpiece. The shot blasting wheel includes a circular body member defining a plurality of slot openings a front surface defines a plurality of slots. Each slot and slot opening has a dovetail configuration. The shot blasting wheel includes a plurality of blade assemblies, each including a paddle positioned in a respective slot via insertion through a respective slot opening. Each blade assembly also includes a locking lever pivotally coupled to the body member and pivotally movable between a locked configuration preventing removal of the paddle from the respective slot and a released configuration allowing removal. Further, each blade assembly includes a dual spring assembly having a lever spring tensioned and biased for movement between extended and released configurations and having a paddle spring configured to resist a paddle lug.

19 Claims, 14 Drawing Sheets

(56) References Cited

U.S. PATENT DOCUMENTS

| | | | | |
|---|---|---|---|---|
| 8,550,881 | B2 | 10/2013 | Loutzenheiser et al. | |
| 9,440,330 | B2 | 9/2016 | Bukach | |
| 10,335,923 | B2 * | 7/2019 | Kim | B24C 3/14 |
| 2004/0166777 | A1 | 8/2004 | Goff | |
| 2011/0117824 | A1 * | 5/2011 | Loutzenheiser | B24C 5/062 451/97 |
| 2021/0078137 | A1 | 3/2021 | Liao et al. | |

FOREIGN PATENT DOCUMENTS

| | | | | |
|---|---|---|---|---|
| GB | 1390958 A | * | 4/1975 | B22D 29/006 |
| GB | 1452044 A | * | 10/1976 | B24C 5/062 |

* cited by examiner

BLAST WHEEL AND QUICK-CONNECT BLADE ASSEMBLY

BACKGROUND OF THE INVENTION

This invention relates generally to shot blast equipment and, more particularly, to a blast wheel assembly having a plurality of blades coupled to a rotor wheel in a dual spring quick connection or replacement assembly.

Machines that have metal surfaces, automotive transmission components like shafts, gears, leaf springs, axle beams, connecting rods, railway components, and the like are all subject to becoming corroded with chemicals, rust, mill scale, and other contaminants. Cleaning or removing the rust or scale can improve or restore the functionality of the part or machine not to mention its aesthetic properties. One method for cleaning contaminated parts is called wheel blasting. Wheel blast equipment uses a centrifugal blast wheel to propel abrasive shot onto the surface of the parts. Metallic abrasives are typically utilized, such as steel shot or grit, zinc or aluminum cut wire, stainless steel shot or grit. More particularly, abrasive shot material may be introduced into the center of a rotating wheel that includes a plurality of radially disposed blades so that the shot is accelerated by the blades and is directed toward an exit opening of the blasting machine and toward a surface of a part to be cleaned.

Various throwing wheel assemblies have been proposed in the art for throwing abrasives against the surfaces of a part in a manner that changes the character of the surface, such as by completely removing contaminants or other undesirable deposits therefrom. Although presumably effective for their intended purposes, there is still a need for a blast wheel assembly with blade connection assembly that allows blades to be attached or replaced using a dual spring and lever assembly.

Therefore, it would be desirable to have a blast wheel and blade connection assembly for throwing abrasives against the surfaces of a part in a manner that changes the character of the surface, such as for cleaning contaminants from surfaces of a metal part. Further, it would be desirable to have a blast wheel and blade connection assembly that includes a plurality of paddles each having a lever and dual spring assembly for connection to a rotor wheel.

SUMMARY OF THE INVENTION

This invention is directed to a shot blasting wheel according to the present invention for use with a shot blasting machine of a type having a motor that drives a rotor wheel to propel abrasive shot outwardly against a workpiece. The shot blasting wheel includes a body member having a peripheral edge defining a circular configuration and having a front surface and a rear surface opposite the front surface, the front and rear surfaces defining a central bore surrounded by a central hub operatively coupled to the motor. The peripheral edge defines a plurality of slot openings spaced apart radially thereabout and the front surface defines a plurality of slots spaced apart radially thereabout, wherein each slot extends between the peripheral edge and the hub and each slot being in communication with a respective shot opening. Each slot opening and slot may have a dovetail configuration.

The shot blasting wheel includes a plurality of blade assemblies, each blade assembly including a paddle positioned in a respective slot via insertion through a respective slot opening. Each blade assembly also includes a locking lever pivotally coupled to the body member adjacent the respective slot and pivotally movable between a locked configuration preventing removal of the paddle from the respective slot and a released configuration allowing the paddle to be slidably removed from the respective slot of the body member.

Further, each blade assembly includes a dual spring assembly having a lever spring tensioned and biased for movement between (1) an extended configuration pushing a lower segment of a respective locking lever across the respective slot so as to resist unintentional removal of a respective paddle and (2) a compressed configuration sandwiched by the lower segment of the respective locking lever to a side wall of the respective slot so as to allow removal of a respective paddle. The dual spring assembly includes a paddle spring perpendicular to and remote from the lever spring, the paddle spring configured to resist a paddle lug.

Therefore, a general object of this invention is to provide a blast wheel blade connection assembly for cleaning contaminants from surfaces of a metal part.

Another object of this invention is to provide a blast wheel apparatus, as aforesaid, that includes a plurality of paddles each configured for quick-connection to the rotor wheel.

Still another object of this invention is to provide a blast wheel apparatus, as aforesaid, in which the blade connection assembly includes the plurality of paddles each having a dual spring-loaded lever, respectively.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
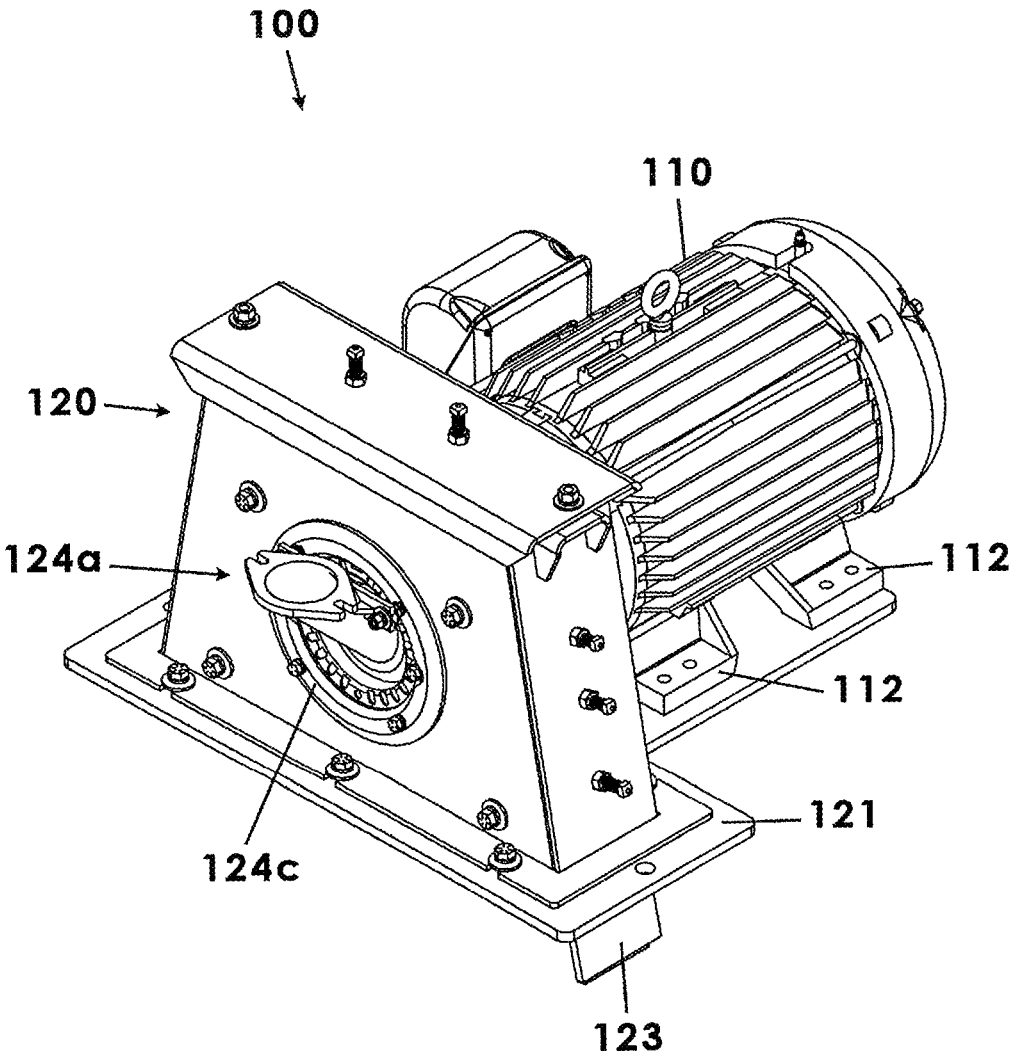
FIG. 1 is a perspective view of a blasting machine more housing a blasting wheel according to a preferred embodiment of the present invention.
Figure 2A:
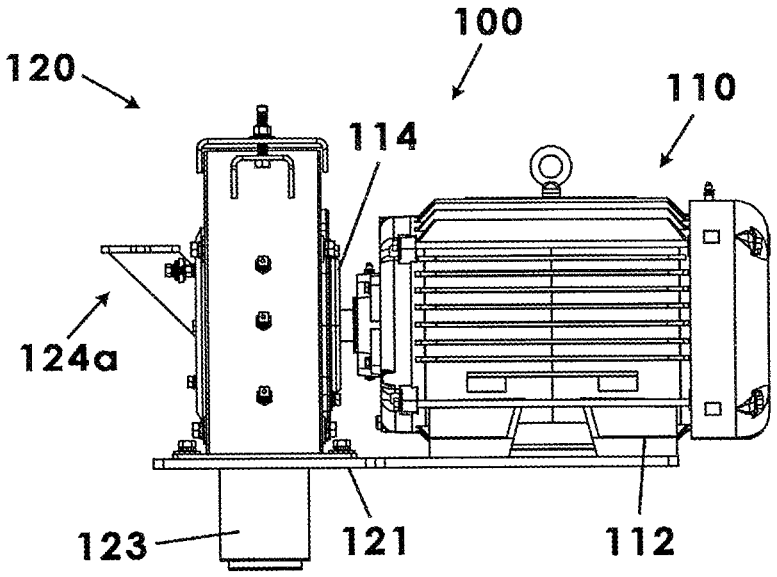
FIG. 2*a* is a side view of the blasting machine as in FIG. 1.
Figure 2B:
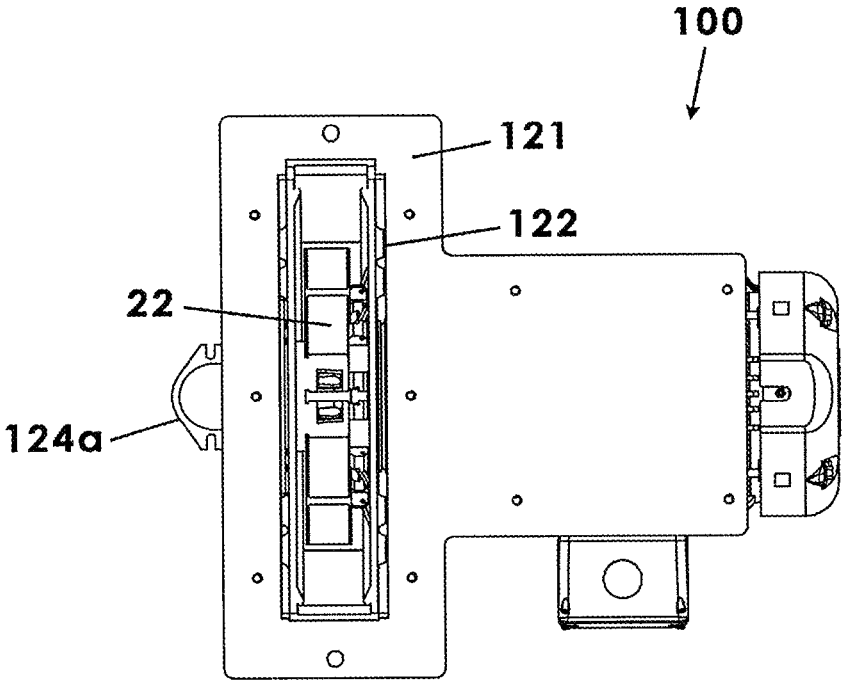
FIG. 2*b* is a bottom view of the blasting machine as in FIG. 2*a;*
Figure 3:
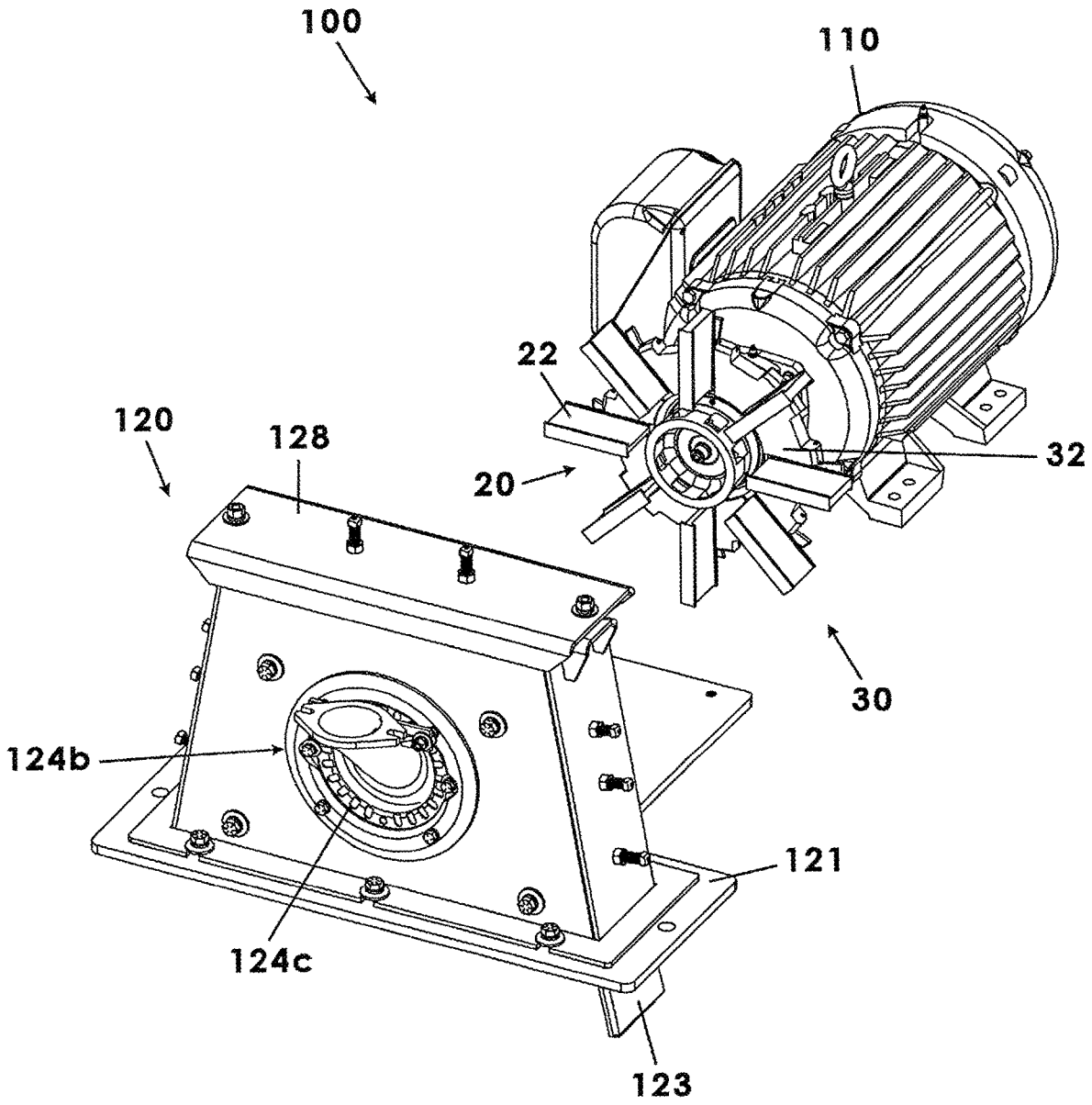
FIG. 3 is an exploded view of the blasting machine as illustrated in FIG. 1.
Figure 4:
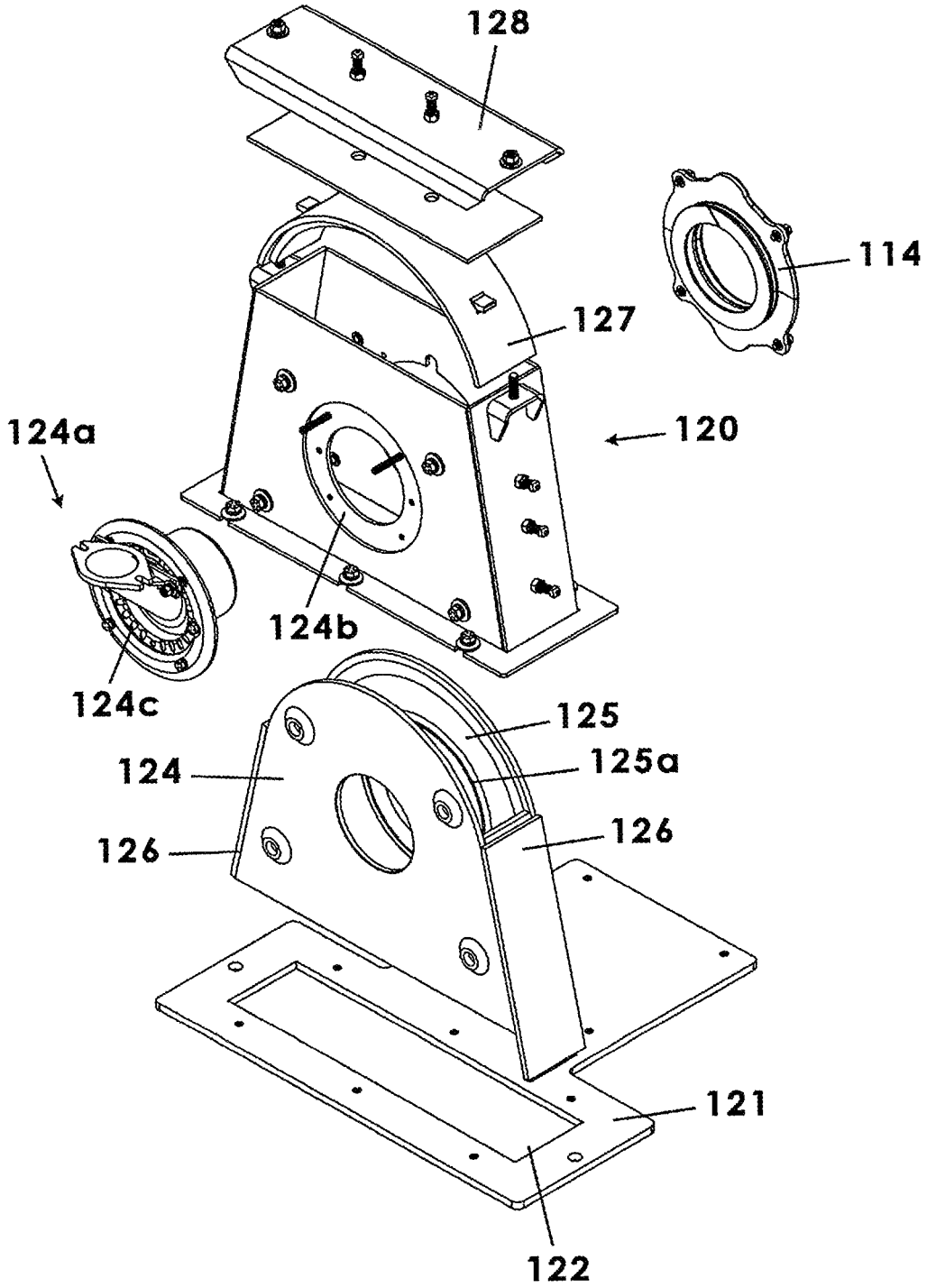
FIG. 4 is an exploded view of a main housing of the blasting machine shown in FIG. 1.

A blast wheel and quick-connect blade assembly according to a preferred embodiment of the present invention will now be described with reference to FIGS. 1 to 12*c* of the accompanying drawings. The blast wheel and quick-connect blade assembly 10 includes a plurality of blade assemblies 20 coupled to a rotor wheel portion 30, each blade assembly 20 including a paddle 22, locking lever 37, and a spring lock assembly 40.

The blast wheel and quick-connect blade assembly 10 according to the present invention is configured for use with a blast wheel apparatus 100 having a motor 110 and a plurality of mounting fasteners 112 configured for mounting the motor 110 and overall assembly 10 to a floor, workbench, or other machinery, such as with bolts. Preferably, the motor 110 is operatively coupled to the rotor wheel portion 30. The rotor wheel portion 30 includes a body member 32 having opposed front 32*a* and rear 32*b* surfaces that define a central bore surrounded by a central hub 34 that rotates about a rotational axis. More particularly, the motor 110 may include a rotatable shaft 112 coupled to the central hub 34 of the rotor body member 32 such that the body member 32 is rotated when the motor 110 is energized in the shaft 112 is rotated.

In an embodiment, the rotor wheel portion 30 is positioned in and protected by a main housing 120 having a base plate 121 defining a longitudinally-extensive outlet 122. The main housing 120 includes at least one leg 123 extending from a lower surface of the base plate 121 such that abrasives may be thrown through the outlet 122 by operation of the paddles 22 as will be described later in more detail. It will be understood that the leg 123 may be an integral component of the outlet whereas to guide the abrasives when expelled as will be described in more detail later. The main housing 120 includes a front wear plate 124 and a back wear plate 125 opposite and parallel to the front wear plate 124, the front and back wear plates extending upwardly and perpendicular from the base plate 121. The back wear plate 125 defines an aperture and a rear seal plate 114. Similarly, the main housing 120 includes a pair of side wear plates 126 opposite one another and each extending upwardly from the base plate 121. In an embodiment, the main housing 120 may include a top wear plate 127 and a top frame plate 128. Together, the multiple plates described above define and interior area configured to hold and protect the rotor wheel portion 30 described above.

Further, the back wear plate 125 of the main housing 120 defines a rear aperture 125*a* through which the rotor wheel portion 30 may be accessed and through which the motor 110 is interfaced with the central hub 34. The rear aperture 125*a* may be removably enclosed by a rear seal member 125*b*. The front wear plate 124 defines a front aperture 124*a* that is in fluid communication with the interior area. In addition, and inlet assembly 124*b* having a tubular configuration and opposed open ends extends away from the aperture 124*a*, the inlet assembly 124*b* being configured to receive and feed abrasives (such as shot, shards of metal, and the like) into the interior space and onto respective paddles 22. In a related aspect, the inlet assembly 124*b* may include a plurality of detents 124*c* configured to regulate the timing or volume of abrasives being distributed to the paddles 22.

The critical aspect of the plurality of blade assemblies 20 each being removably coupled to the rotor wheel portion 30 will now be discussed in detail. The rotor wheel portion includes a body member 32 (a.k.a. a rotary body plate) having a generally circular configuration defining a central bore surrounded by a central hub 34. Each blade assembly 20 includes a paddle 22 that is removably coupled to a peripheral edge 33 and front surface 32*a* of the body member 32. More particularly, the peripheral edge 33 and front surface 32*a* together define a plurality of slots 35, each slot 35 extending from a slot opening 36 defined by the peripheral edge 33 to the central hub 34 and each slot 35 having a dovetail configuration. Correspondingly, each paddle 22 includes a lower edge that includes a lug 24 extending outwardly therefrom and having a dovetail configuration. Each slot 35 is configured to receive a respective lug 24 and, therefore, a respected paddle 22 in a slidable relationship. Stated another way, respective paddles 22 are slidably received in respective slots when a perspective lug passes through a respective slot opening 36 and slides into and along a respective slot 35. It is understood that said respective paddles 22 are prevented from being intentionally or unintentionally upwardly dislodged by the meeting dovetail configurations of slots and logs, respectively.

Figure 5A:
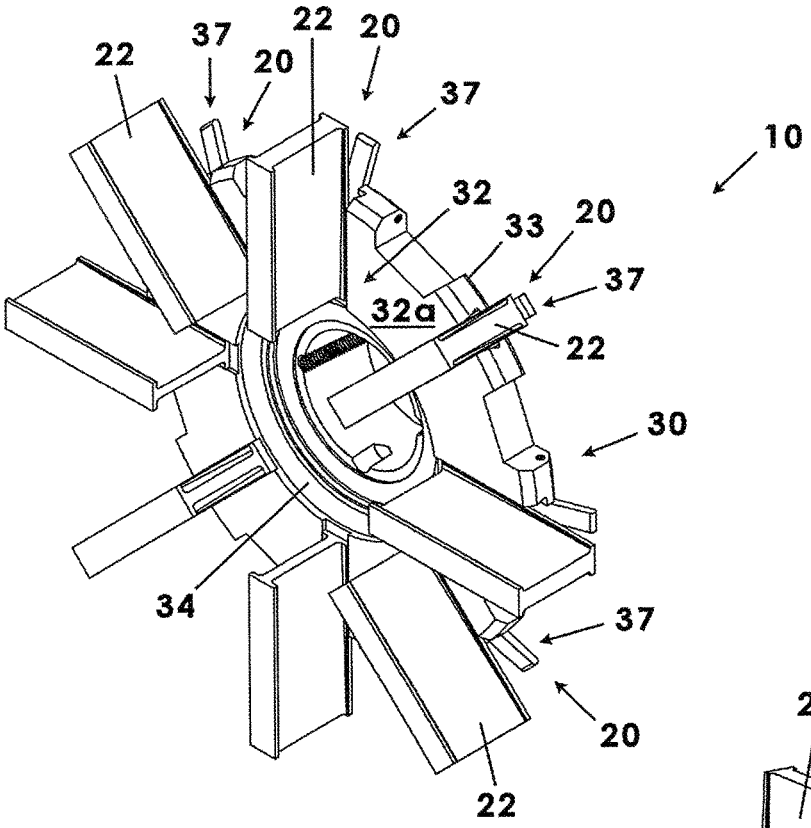
FIG. 5*a* is a front perspective view of a rotor wheel portion of the blasting machine isolated and enlarged from the exploded view shown and FIG. 3.
Figure 5B:
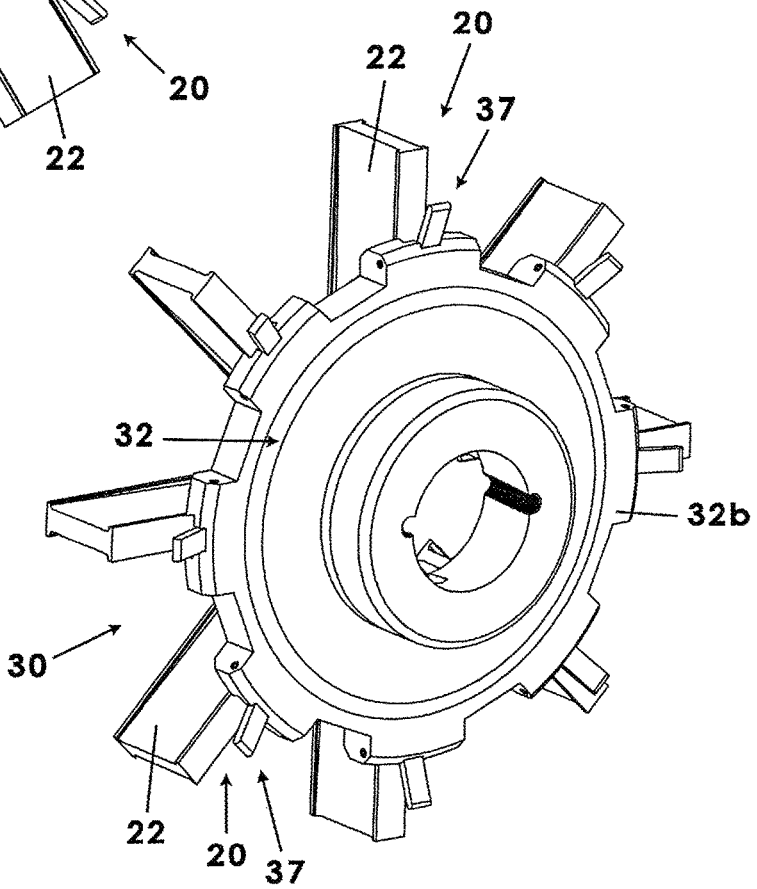
FIG. 5*b* is a rear perspective view of the rotor wheel portion shown in FIG. 5*b;*
Figure 6A:
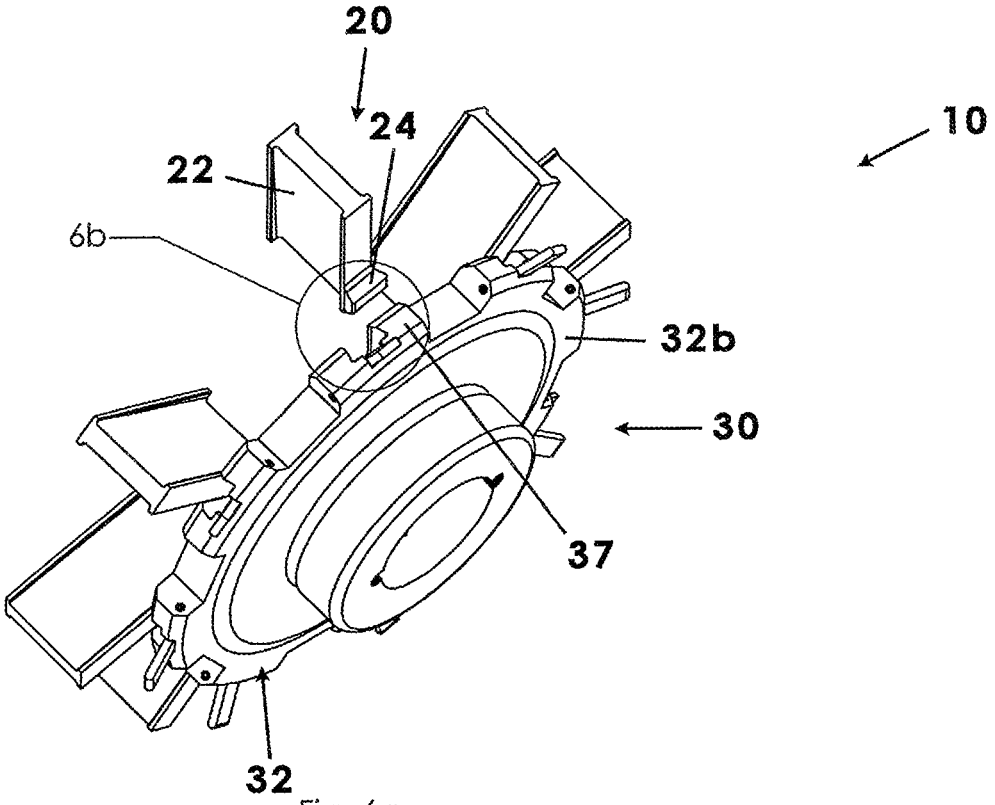
FIG. 6*a* is partially exploded view of the rotor wheel portion shown in FIG. 5*b;*
Figure 6B:
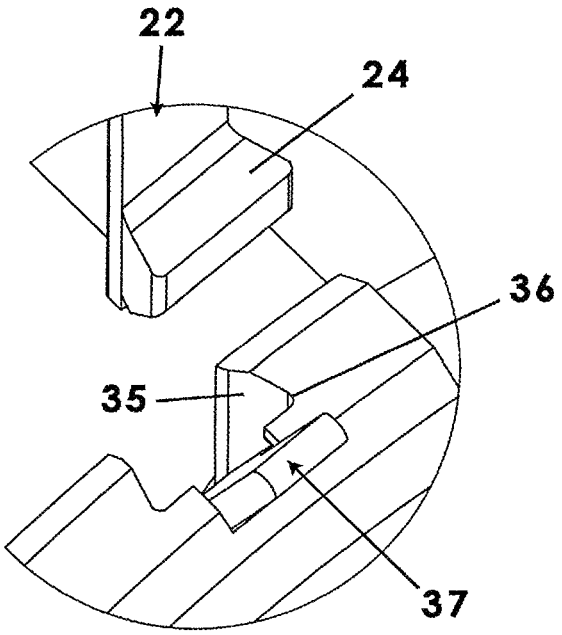
FIG. 6*b* is an isolated view on an enlarged scale taken from FIG. 6*a;*

Regarding the plurality of paddles 22, each paddle may have a generally rectangular configuration. As shown in FIGS. 5*a* and 5*b*, each paddle 22 may have a configuration similar to that of an I-beam—namely having a flat surface bounded by opposed upstanding side edges so as to be capable of collecting abrasives from the inlet assembly 124*b* before thrusting them through the outlet 122 when the rotor wheel portion 30 is 7centrifugally rotated at high speed when actuated by the motor 110.

Figure 7A:
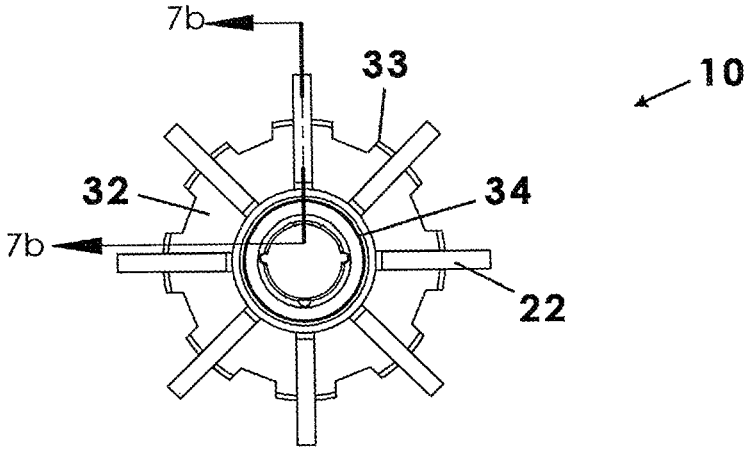
FIG. 7*a* is a front view of the rotor wheel portion shown in FIG. 5*a;*
Figure 7B:
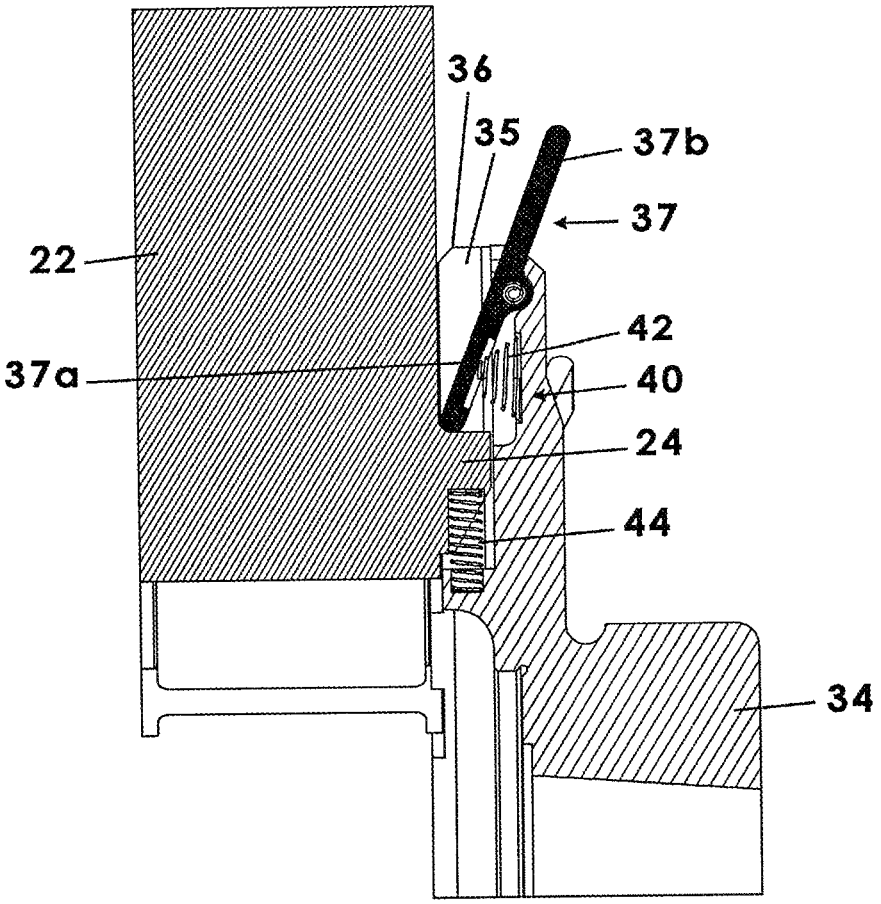
FIG. 7*b* is a sectional view taken along line 7*b*-7*b* of FIG. 7*a* illustrating a configuration of a locking lever and dual spring assembly securing a paddle.
Figure 8A:
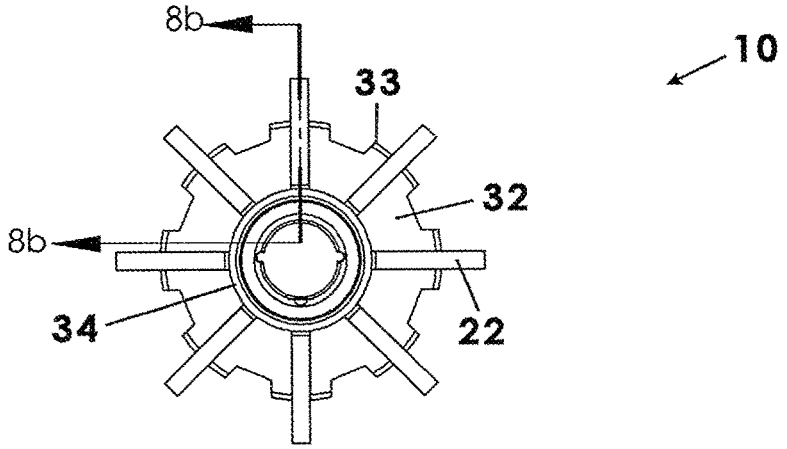
FIG. 8*a* is a front view of the rotor wheel portion shown in FIG. 5*a;*
Figure 8B:
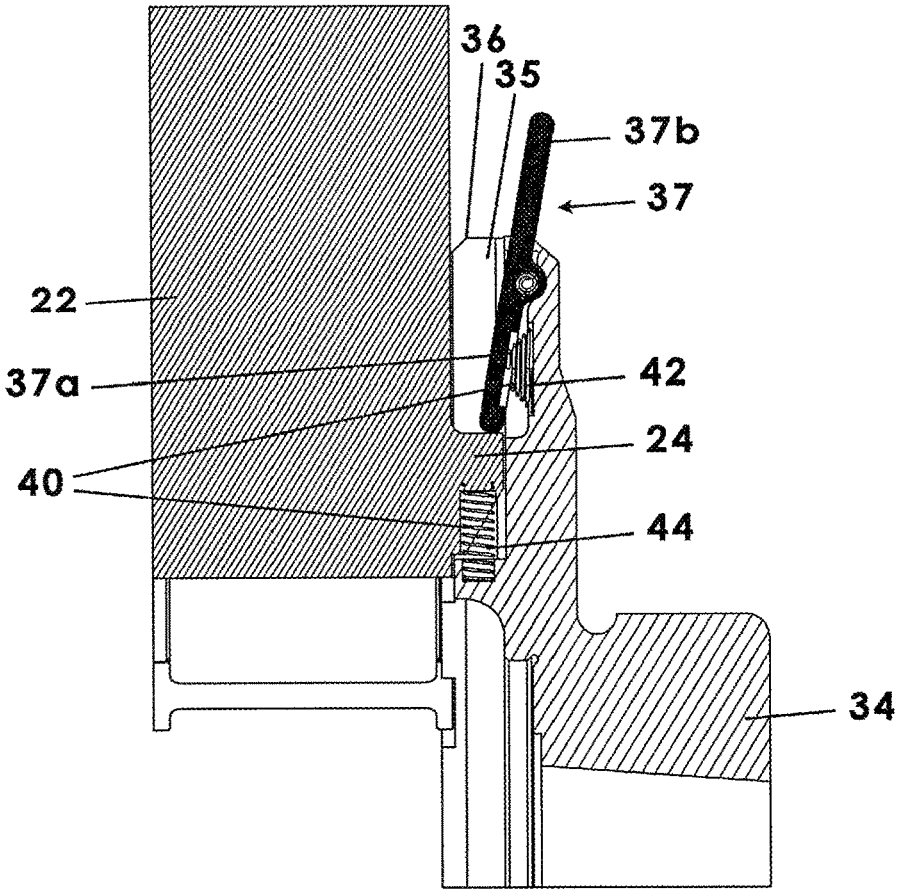
FIG. 8*b* is a sectional view taken along line 8*b*-8*b* of FIG. 8*a* illustrating a configuration of a locking lever and dual spring assembly securing a paddle.

In another critical aspect, each blade assembly 20 includes a locking lever 37 and a dual spring assembly 40 that (1) further secures insertion and placement of a paddle 22 when at a locked configuration and (2) allows removal of a paddle 22 when at a released configuration. In other words, a user is able to insert and temporarily secure a paddle 22 along a respective slot 35 as this action will, at first, find locking lever 37 and dual spring assembly 40 at a completely relaxed configuration (FIG. 11*b*) and will forcibly move the locking lever 37 and dual spring assembly 40 to a partially inserted configuration (FIGS. 10*b* and 9*b*) and then a fully inserted and locked configuration (FIG. 7*b*).

More particularly, each blade assembly 20 includes a locking lever 37 that is pivotally coupled at a midpoint thereof to the body member 32 of the rotor wheel portion 30, the locking lever 37 having a linear configuration and a lower segment 37*a* in communication with a corresponding slot 35. Accordingly, the lower segment 37*a* is moved into the slot 35 when an upper segment 37*b* is moved away from the slot 35, and vice versa, i.e., as the locking lever 37 is moved toward or away from the locked configuration. This lateral movement can be seen by comparing FIGS. 7*b*, 8*b*, 9*b*, 10*b*, and 11*b*.

The dual spring assembly 40 will now be discussed in detail. Preferably, each spring discussed below is an extension spring that may be compressed by absorbing pressure against it and which is naturally resilient to return to its original configuration by releasing the absorbed pressure against it. In fact, a compression spring is naturally biased to push outwardly against whatever article material is compressing it. Although springs are preferred in the present application, it is understood that other elastic or resilient materials may work as well.

Figure 10A:
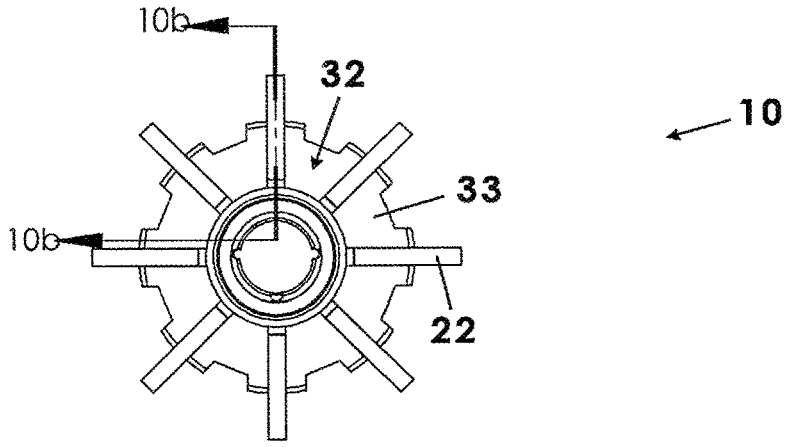
FIG. 10*a* is a front view of the rotor wheel portion shown in FIG. 5*a;*
Figure 10B:
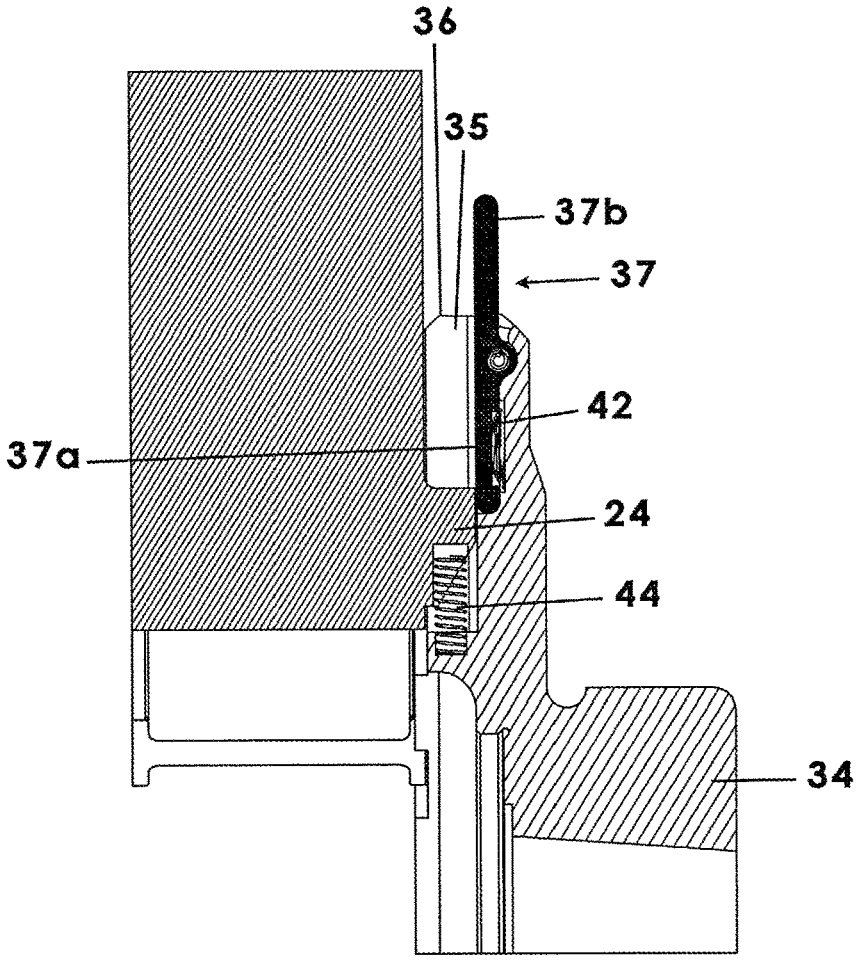
FIG. 10*b* is a sectional view taken along line 10*b*-10*b* of FIG. 10*a* illustrating another configuration of a locking lever and dual spring assembly securing a paddle.
Figure 11A:
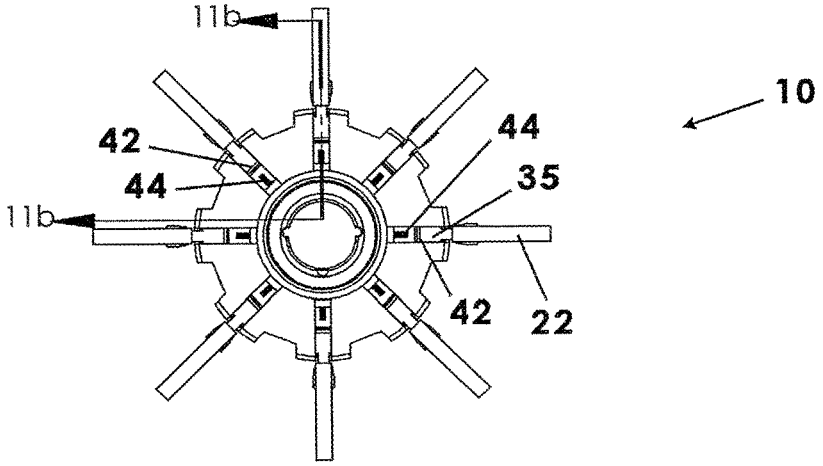
FIG. 11*a* is a front view of the rotor wheel portion shown in FIG. 5*a;*
Figure 11B:
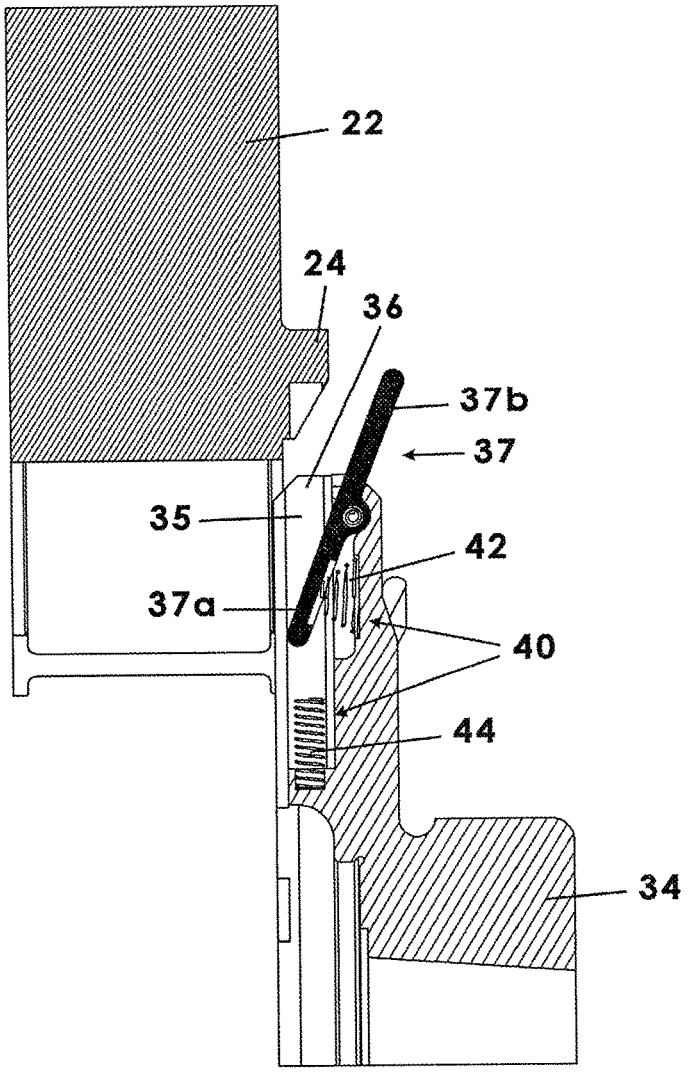
FIG. 11*b* is a sectional view taken along line 11*b*-11*b* of FIG. 11*a* illustrating another configuration of a locking lever and dual spring assembly securing a paddle.
Figure 12A:
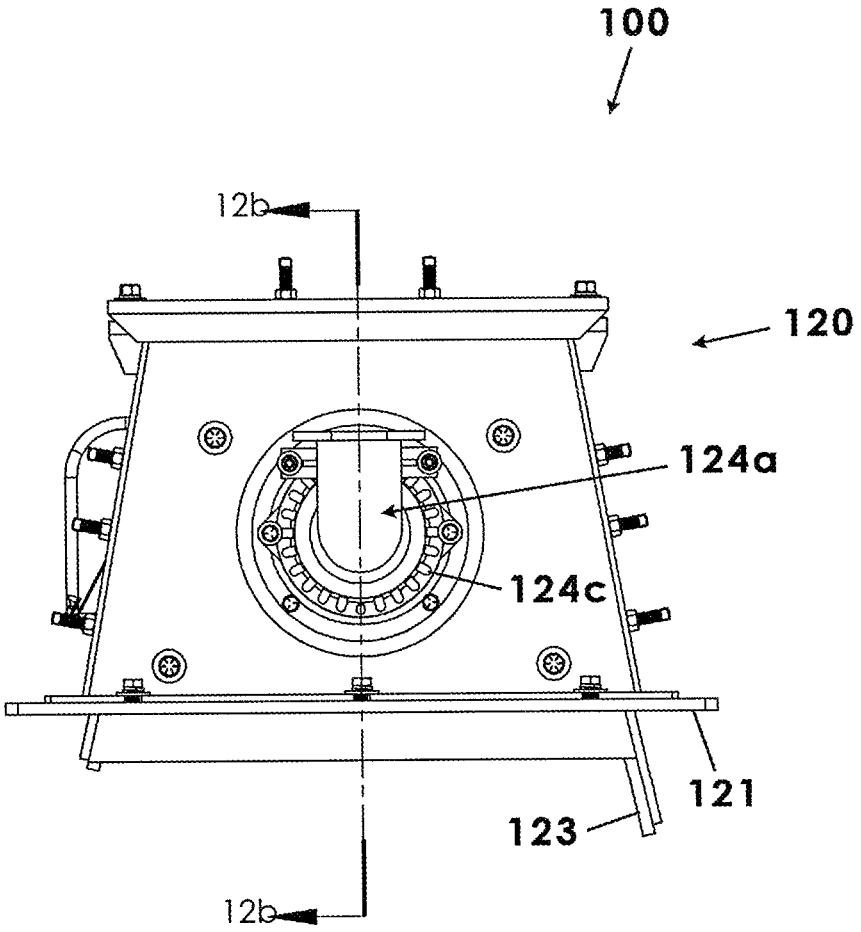
FIG. 12*a* is a front view of the blasting machine as in FIG. 1.
Figure 12B:
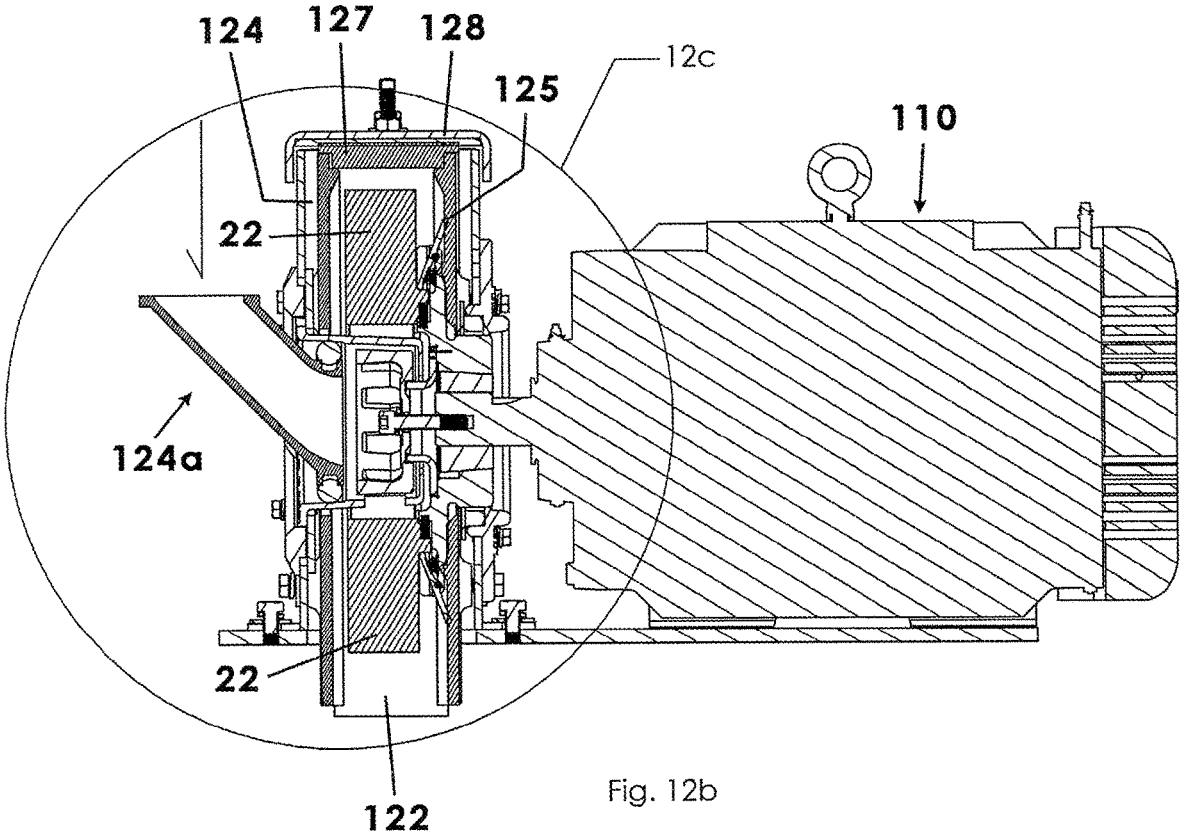
FIG. 12*b* is a sectional view taken along line 12*b*-12*b* of FIG. 12*a*, Illustrating the rubber wheel portion mounted in the main housing of the blasting machine.
Figure 12C:
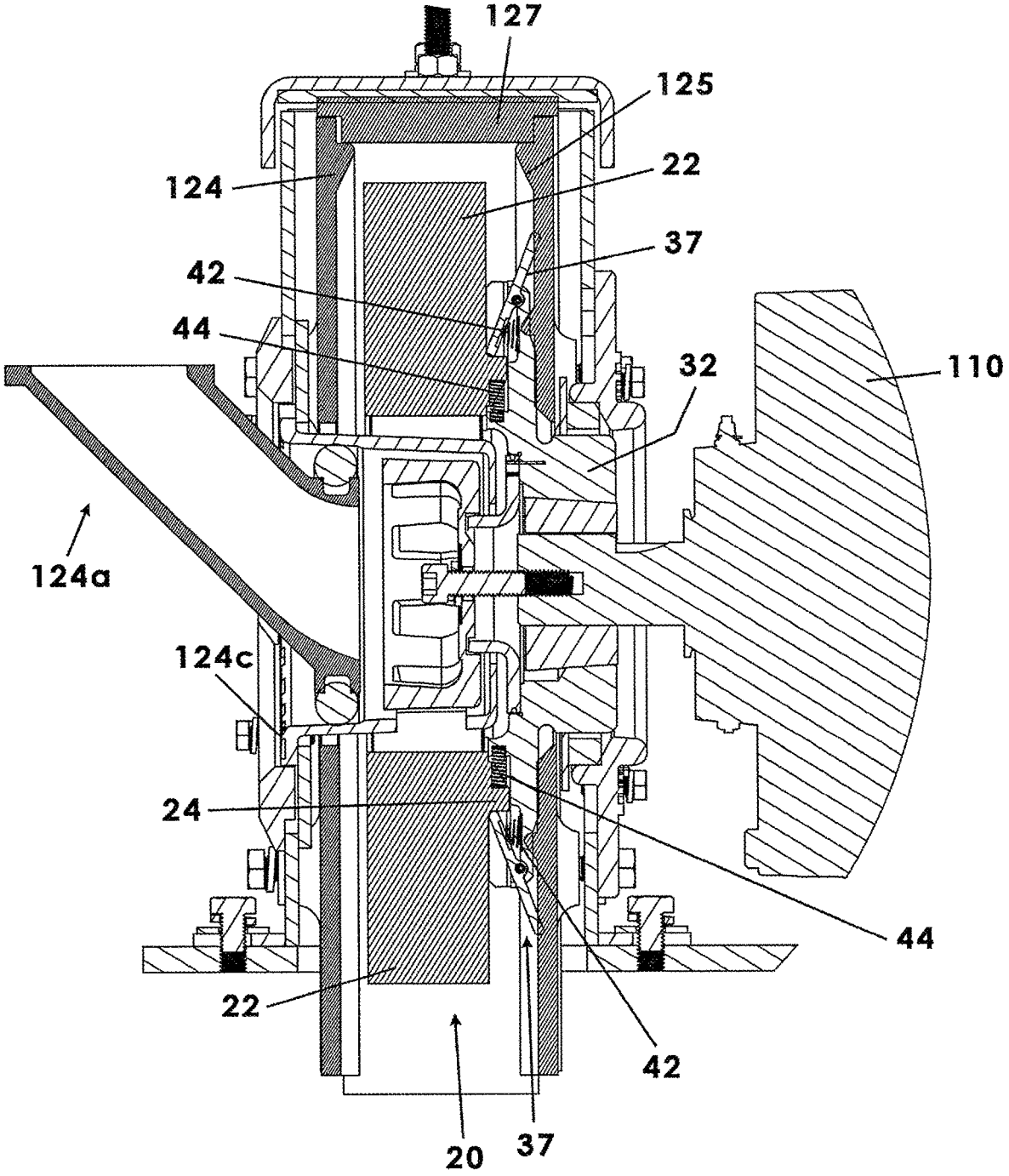
FIG. 12*c* is an isolated view on an enlarged scale taken from FIG. 12*b*.

The dual spring assembly 40 includes a lever spring 42 (also referred to as a first resilient member) that may be coupled to a sidewall of each slot 35 and the front surface of the body member and is biased to extend transversely across or into that slot 35, respectively preferably, lever spring 42 is positioned adjacent to a proximal end of the corresponding slot and lower segment 37*a* of a locking lever 37. Normally, the lever spring 42 is biased to push a corresponding lower segment 37*a* into a corresponding slot 35 both when there is no paddle 22 inserted into a corresponding slot 35 as well as when a paddle 22 and its respective lug 24 has traveled beyond a free end of the respective lower segment 30*a* as shown in FIG. 7*b*. By contrast, a respective lower segment 37*a* is pushed away from a corresponding slot 35 (which compresses a corresponding lever spring 42) by a respective lug 24 of a respective paddle 22 being inserted into the respective slot 35 as shown in FIG. 10*b*.

Figure 9A:
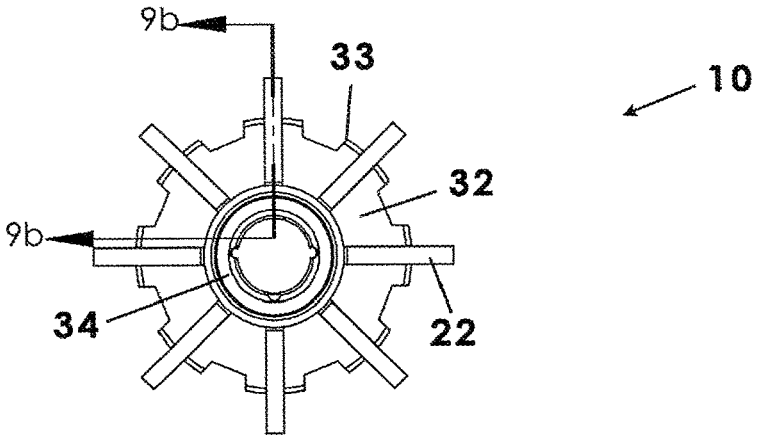
FIG. 9*a* is a front view of the rotor wheel portion shown in FIG. 5*a;*
Figure 9B:
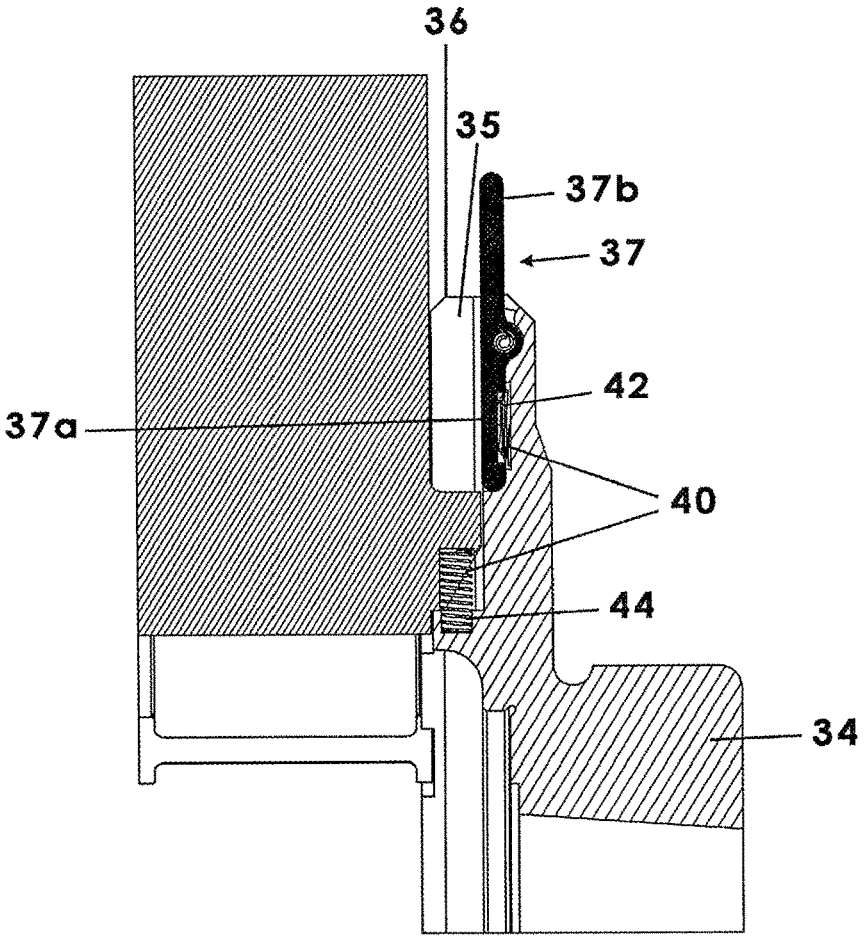
FIG. 9*b* is a sectional view taken along line 9*b*-9*b* of FIG. 9*a* illustrating another configuration of a locking lever and dual spring assembly securing a paddle.

The dual spring assembly 40 further includes a paddle spring 44 (also referred to as a second resilient member) that also may be coupled to the body member 32 and positioned deeper in each slot 35, each paddle spring 44 being longitudinally parallel with the surface of the body member 32 and with the longitudinal extent of the slot 35 itself. When relaxed, the paddle spring 44 is naturally biased to extend upwardly within a respective slot 35 when no paddle 22 is inserted therein (FIGS. 11*b*) and even when a paddle 22 is only partially inserted (FIG. 10*b*) but is compressed by a respective lug 24 when a respective paddle 22 is fully inserted (FIG. 9*b*). It is understood that a respective lower segment 37*a* will be naturally pushed again into a respective slot 35 by a respective lever spring 42 to when the lug 24 has been fully inserted (FIG. 8*b*) and that a corresponding paddle spring 44, having been partially compressed, will naturally push upwardly against lug 24.

Preferably, the lever spring 42 has a relatively strong tension or, stated another way, has a tension sufficiently strong to hold a paddle 22 in an inserted configuration under normal use conditions while sufficiently weak such that only user can overcome it by manually operating/pivoting a respective locking lever 37 the released configuration which intentionally compresses the lever spring 42. In other words, the user is able to quickly unlock or release an inserted paddle 20 by pushing a respective locking lever 37 toward a corresponding paddle 22 and slot 35 which pivots said locking lever 37 toward the released configuration and allows the paddle to be slidably removed. It is understood that the resilience of the paddle spring 44 will push a released paddle 22 and, thus, make its removal even easier.

In use, the entire blast wheel apparatus 100 may be mounted atop another machine having surfaces intended to be cleaned or otherwise "blasted" by the blast wheel and quick-connect blade assembly 10. Similarly, the blast wheel apparatus 100 may be mounted to a mobile device, such as would be appropriate for use on a roadway or area outside of a shop. It is well-known that the blades or paddles associated with a shot blasting wheel tend to wear down or wear out over time and need to be replaced. Unfortunately, the blasting wheel must be deactivated and, in the past, partially disassembled in order to replace a faulty blade. By contrast, the paddle 22 according to the present invention may be released and a new paddle 22 reinserted by means of a quick-connect manipulation of a respective locking lever 37 in communication with a corresponding dual spring assembly 40.

It is understood that while certain forms of this invention have been illustrated and described, it is not limited thereto except insofar as such limitations are included in the following claims and allowable functional equivalents thereof.

The invention claimed is:

1. A rotatable shot blasting wheel of a type that uses centrifugal rotation to throw abrasive shot against a workpiece when a motor is energized, said rotatable shot blasting wheel comprising:

a body member having a peripheral edge defining a circular configuration and having a front surface and a rear surface opposite said front surface, said front and rear surfaces defining a central bore surrounded by a central hub that rotates about a rotational axis and is operatively coupled to the motor;

wherein said peripheral edge defines a plurality of slot openings spaced apart radially thereabout and said front surface defines a plurality of slots spaced apart radially thereabout, wherein each slot extends between said peripheral edge and said central hub and said each slot being in communication with a respective slot opening;

a plurality of blade assemblies each having (1) a paddle positioned in a respective slot, upon insertion through a respective slot opening and (2) a locking lever pivotally coupled to said body member adjacent said respective slot and pivotally movable about an axis transverse to said rotational axis between a locked configuration in which the lever engages a side edge of the paddle preventing removal of said paddle and a released configuration allowing said paddle to be slidably removed from said body member.

2. The rotatable shot blasting wheel as in claim 1, wherein:

said plurality of slots each includes a dovetail configuration;

said plurality of slot openings each includes a dovetail configuration; and each paddle of said plurality of blade assemblies includes a lug extending from a lower edge and having a dovetail configuration that is slidably complementary to respective dovetail configurations of said plurality of slots and said plurality of slot openings, respectively.

3. The rotatable shot blasting wheel as in claim 2, wherein said each blade assembly includes a first resilient member coupled to said front surface of said body member adjacent a respective slot, said first resilient member being naturally biased for movement between an extended configuration extending across said respective slot and a compressed configuration sandwiched by a lower segment of respective locking lever to a side wall of said respective slot.

4. The rotatable shot blasting wheel as in claim 3, wherein said first resilient member is a compression spring.

5. The rotatable shot blasting wheel as in claim 3, wherein said each blade assembly includes a second resilient member positioned in said respective slot longitudinally downstream from said first resilient member and aligned with an imaginary longitudinal axis defined by said respective slot, said second resilient member being naturally biased for movement between an extended configuration pushing in a direction toward a respective slot opening and a compressed configuration being pressed downwardly by a respective lug of a respective paddle.

6. The rotatable shot blasting wheel as in claim 5, wherein said second resilient member is a compression spring.

7. The rotatable shot blasting wheel as in claim 5, wherein said second resilient member is mounted perpendicular to said first resilient member.

8. The rotatable shot blasting wheel as in claim 1, wherein:

a respective locking lever includes opposed ends that define a linear configuration and a midpoint between said opposed ends, said locking lever being pivotally coupled at said midpoint to said front surface of said body member adjacent a respective slot, said respective locking lever having a lower segment that is pivotally movable to a locked configuration blocking said respective slot and a released configuration adjacent and not blocking said respective slot; and said respective locking lever having an upper segment juxtaposed from said lower segment such that movement of said upper segment of said respective locking lever toward said respective slot pivotally urges said lower segment toward said released configuration.

9. The rotatable shot blasting wheel as in claim 3, wherein:

a respective locking lever has a linear configuration and defines a midpoint between opposed ends, said locking lever being pivotally coupled at said midpoint to said front surface of said body member adjacent a respective slot, said respective locking lever having a lower segment that is pivotally movable to a locked configuration blocking said respective slot and a released configuration adjacent to and not blocking said respective slot;

said first resilient member is positioned adjacent said lower segment of said respective locking lever; and said first resilient member expands toward said extended configuration when said lower segment of said respective locking lever is at said locked configuration and is pressed toward said compressed configuration by said lower segment at said released configuration.

10. The rotatable shot blasting wheel as in claim 1, wherein said each blade assembly includes:

a first spring member coupled to said front surface of said body member adjacent a respective slot, said first spring member being naturally tensioned and biased for movement between (1) an extended configuration pushing a lower segment of a respective locking lever across said respective slot so as to resist unintentional removal of a respective paddle and (2) a compressed configuration sandwiched by said lower segment of said respective locking lever to a side wall of said respective slot; and a second spring member positioned in said respective slot longitudinally downstream from said first spring member and aligned with an imaginary longitudinal axis defined by said respective slot, said second spring member being naturally tensioned and biased for movement between an extended configuration pushing outwardly in opposition to insertion of a respective paddle and a compressed configuration being pressed downwardly by a respective lug of a respective paddle.

11. A shot blasting wheel for a shot blasting machine of a type having a motor that drives abrasive shot outwardly against a workpiece, said shot blasting wheel comprising:

a body member having a peripheral edge defining a circular configuration and having a front surface and a rear surface opposite said front surface, said front and rear surfaces defining a central bore surrounded by a central hub operatively coupled to the motor, said peripheral edge defining a plurality of slot openings spaced apart radially thereabout and said front surface defines a plurality of slots spaced apart radially thereabout, wherein each slot extends between said peripheral edge and said hub and said each slot being in communication a respective shot opening;

a plurality of blade assemblies each blade assembly comprising:

a paddle positioned in a respective slot via insertion through a respective slot opening;

a locking lever pivotally coupled to said body member adjacent said respective slot and pivotally movable between a locked configuration preventing removal of said paddle from said respective slot and a released configuration allowing said paddle to be slidably removed from said respective slot of said body member;

a dual spring assembly having a lever spring tensioned and biased for movement between (1) an extended configuration pushing a lower segment of a respective locking lever across said respective slot so as to resist unintentional removal of a respective paddle and (2) a compressed configuration sandwiched by said lower segment of said respective locking lever to a side wall of said respective slot so as to allow removal of a respective paddle and wherein said dual spring assembly further includes a paddle spring positioned in said respective slot longitudinally downstream from said lever spring and aligned with an imaginary longitudinal axis defined by said respective slot, said paddle spring being naturally tensioned and biased for movement between an extended configuration pushing outwardly in opposition to insertion of a respective paddle and a compressed configuration being pressed downwardly by a respective lug of a respective paddle.

12. The shot blasting wheel as in claim 11, wherein:

said plurality of slots each includes a dovetail configuration;

said plurality of slot openings each includes a dovetail configuration; and each paddle of said plurality of blade assemblies includes a lug extending from a lower edge and having a dovetail configuration that is slidably complementary to respective dovetail configurations of said plurality of slots and said plurality of slot openings, respectively.

13. The shot blasting wheel as in claim 12, wherein:

said lever spring is a compression spring that is resilient after being compressed to return to an extended configuration;

said paddle spring is a compression spring that is resilient after being compressed to return to an extended configuration.

14. The shot blasting wheel as in claim 12, wherein:

a respective locking lever has a linear configuration and defines a midpoint between opposed ends, said locking lever being pivotally coupled at said midpoint to said front surface of said body member adjacent a respective slot, said respective locking lever having a lower segment that is pivotally movable to a locked configuration blocking said respective slot and a released configuration adjacent to and not blocking said respective slot;

said lever spring is positioned adjacent said lower segment of said respective locking lever; and said lever spring expands toward said extended configuration when said lower segment of said respective locking lever is at said locked configuration and is pressed toward said compressed configuration by said lower segment at said released configuration.

15. A shot blasting machine of a type drives abrasive shot outwardly against a workpiece, said shot blasting wheel comprising:

a motor;

a main housing having a base plate and a pair of legs depending from a lower surface of said base plate, said base plate defining an outlet through which abrasives may be thrown, said main housing including front, rear, side, and top wear plates that, together, define an interior area;

a rotor wheel portion positioned in said interior area, said rotor wheel portion having a body member having a peripheral edge defining a circular configuration and having a front surface and a rear surface opposite said front surface, said front and rear surfaces defining a central bore surrounded by a central hub that rotates about a rotational axis and is operatively coupled to the motor, said peripheral edge defining a plurality of slot openings spaced apart radially thereabout and said front surface defines a plurality of slots spaced apart radially thereabout, wherein each slot extends between said peripheral edge and said hub and said each slot being in communication with a respective slot opening;

a plurality of blade assemblies each blade assembly comprising:

a paddle positioned in a respective slot via insertion through a respective slot opening;

a locking lever pivotally coupled to said body member adjacent said respective slot about an axis transverse to said rotational axis and pivotally movable between a locked configuration in which the lever engages a side edge of the paddle preventing removal of said paddle from said respective slot and a released configuration allowing said paddle to be slidably removed from said respective slot of said body member;

a dual spring assembly having a lever spring tensioned and biased for movement between (1) an extended configuration pushing a lower segment of a respective locking lever across said respective slot so as to resist unintentional removal of a respective paddle and (2) a compressed configuration sandwiched by said lower segment of said respective locking lever to a side wall of said respective slot so as to allow removal of a respective paddle;

wherein:

said plurality of slots each includes a dovetail configuration;

said plurality of slot openings each includes a dovetail configuration; and each paddle of said plurality of blade assemblies includes a lug extending from a lower edge and having a dovetail configuration that is slidably complementary to respective dovetail configurations of said plurality of slots and said plurality of slot openings, respectively.

16. The shot blasting machine as in claim 15, wherein said dual spring assembly includes a paddle spring positioned in said respective slot longitudinally downstream from said lever spring and aligned with an imaginary longitudinal axis defined by said respective slot, said paddle spring being naturally tensioned and biased for movement between an extended configuration pushing outwardly in opposition to insertion of a respective paddle and a compressed configuration being pressed downwardly by a respective lug of a respective paddle.

17. The shot blasting machine as in claim 15, wherein said paddle includes a generally rectangular configuration having an upper surface and a pair of opposed sidewalls extending upwardly from said upper surface such that said upper surface is configured to retain the abrasive shot.

18. The shot blasting machine as in claim 16, wherein said paddle spring is mounted perpendicular to said lever spring.

19. The rotatable shot blasting wheel as in claim 15, wherein:

a respective locking lever includes opposed ends that define a linear configuration and a midpoint between said opposed ends, said locking lever being pivotally coupled at said midpoint to said front surface of said body member adjacent a respective slot, said respective locking lever having a lower segment that is pivotally movable to a locked configuration blocking said respective slot and a released configuration adjacent and not blocking said respective slot; and said respective locking lever having an upper segment juxtaposed from said lower segment such that movement of said upper segment of said respective locking lever toward said respective slot pivotally urges said lower segment toward said released configuration.

* * * * *